US008429798B1

(12) United States Patent
Paigen

(10) Patent No.: US 8,429,798 B1
(45) Date of Patent: Apr. 30, 2013

(54) FASTENING DEVICE

(76) Inventor: Mark Paigen, Winchester, MA (US)

( * ) Notice: Subject to any disclaimer, the term of this patent is extended or adjusted under 35 U.S.C. 154(b) by 0 days.

(21) Appl. No.: 13/456,632

(22) Filed: Apr. 26, 2012

(51) Int. Cl.
*A44B 11/22* (2006.01)

(52) U.S. Cl.
USPC ..... 24/176; 24/35; 24/265 BC; 224/150; 224/913

(58) Field of Classification Search ..... None
See application file for complete search history.

(56) References Cited

U.S. PATENT DOCUMENTS 847,064 A * 3/1907 Griffin ..... 24/176
1,320,835 A * 11/1919 Braxton ..... 24/35
1,782,835 A * 11/1930 Wunsche ..... 54/71
2,059,949 A * 11/1936 Imler ..... 224/150
5,127,136 A 7/1992 Magnus
2009/0126083 A1 * 5/2009 Holtzclaw, Jr. ..... 2/300

OTHER PUBLICATIONS

Webpage ad for a 210 Conway buckle, downloaded from http://www.outfitterssupply.com/210-Conway-Buckle/productinfo/WHW210/ on Apr. 27, 2012, two pages.

* cited by examiner

*Primary Examiner* — Jack W. Lavinder
(74) *Attorney, Agent, or Firm* — The Marbury Law Group, PLLC

(57) ABSTRACT

Fastening devices for fastening at least two strap portions. The fastening device may be, for example, a buckle, and the device may fasten respective ends of a single strap, such as a belt. The fastening device contains no moving parts, and may comprise a unitary, one-piece structure. In embodiments, the fastening device is configured to enable either the first strap portion and the second strap portion to be removed from the fastening device without requiring the other strap portion to be removed.

24 Claims, 7 Drawing Sheets

FASTENING DEVICE

BACKGROUND

Fastening devices are known that allow two strap portions to be easily and securely fastened and unfastened by a user. A buckle, for example, is used to fasten two ends of a belt or other strap. Most commonly, one end of the belt or strap is permanently attached to the buckle, and the other end may be fastened to the buckle in an adjustable manner. Other fastening devices allow for adjustments to both ends of the belt or strap, although making adjustments to one of the ends typically also requires removing the other end. Many fastening devices utilize moving parts, such as an articulating prong that is inserted through a hole in a strap to hold the strap in place. There is a continuing need for further improvements in the design of fastening devices, such as buckles.

SUMMARY

Embodiments include a fastening device that comprises a plate member having a first surface and a second surface opposite the first surface, the first surface being configured to receive a first strap portion such that the first strap portion may extend over and adjacent to the first surface and the second surface being configured to receive a second strap portion such that the second strap portion may extend over and adjacent to the second surface, a first protrusion extending from the first surface such that when the first surface receives the first strap portion, the first protrusion is configured to extend into an opening in the first strap portion to inhibit lateral movement of the first strap portion relative to the plate member, and a second protrusion extending from the second surface such that when the second surface receives the second strap portion, the second protrusion is configured to extend into an opening in the second strap portion to inhibit lateral movement of the second strap portion relative to the plate member. In embodiments, the fastening device comprises at least one first retaining member attached to the plate member and extending at least partially above the first surface and at least one second retaining member attached to the plate member and extending at least partially above the second surface.

In various embodiments, the fastening device contains no moving parts, and may comprise a unitary, one-piece structure. In embodiments, the fastening device is configured to enable either the first strap portion or the second strap portion to be removed from the fastening device without requiring the other strap portion to be removed.

Various embodiments include methods of fastening at least two strap portions using a fastening device that comprise positioning a first strap portion over a first surface of a plate member, aligning an opening in the first strap portion with a first protrusion extending from the first surface of the plate member, inserting the first protrusion into the opening in the first strap portion, positioning a second strap portion over a second surface of a plate member, the second surface being opposite the first surface of the plate member, aligning an opening in the second strap portion with a second protrusion extending from the second surface of the plate member, and inserting the second protrusion into the opening in the second strap portion.

Various embodiments include straps for use with a fastening device that comprise a first strap portion comprising a first plurality of openings having a size and shape corresponding to a first protrusion on a fastening device, the first plurality of openings having a first spacing, and a second strap portion comprising a second plurality of openings having a size and shape corresponding to a second protrusion on a fastening device, the second plurality of openings having a second spacing that is not the same as the first spacing.

BRIEF DESCRIPTION OF THE DRAWINGS

The accompanying drawings, which are incorporated herein and constitute part of this specification, illustrate example embodiments of the invention, and together with the general description given above and the detailed description given below, serve to explain the features of the invention.

DETAILED DESCRIPTION

The various embodiments will be described in detail with reference to the accompanying drawings. Wherever possible, the same reference numbers will be used throughout the drawings to refer to the same or like parts. References made to particular examples and implementations are for illustrative purposes, and are not intended to limit the scope of the invention or the claims.

Various embodiments include fastening devices for fastening at least two strap portions. The fastening device may be, for example, a buckle, and the device may fasten respective ends of a single strap, such as a belt. In some embodiments, the device may fasten at least two portions of different straps. Further embodiments include methods of fastening at least two strap portions, and straps for use with the present fastening devices.

Figure 1:
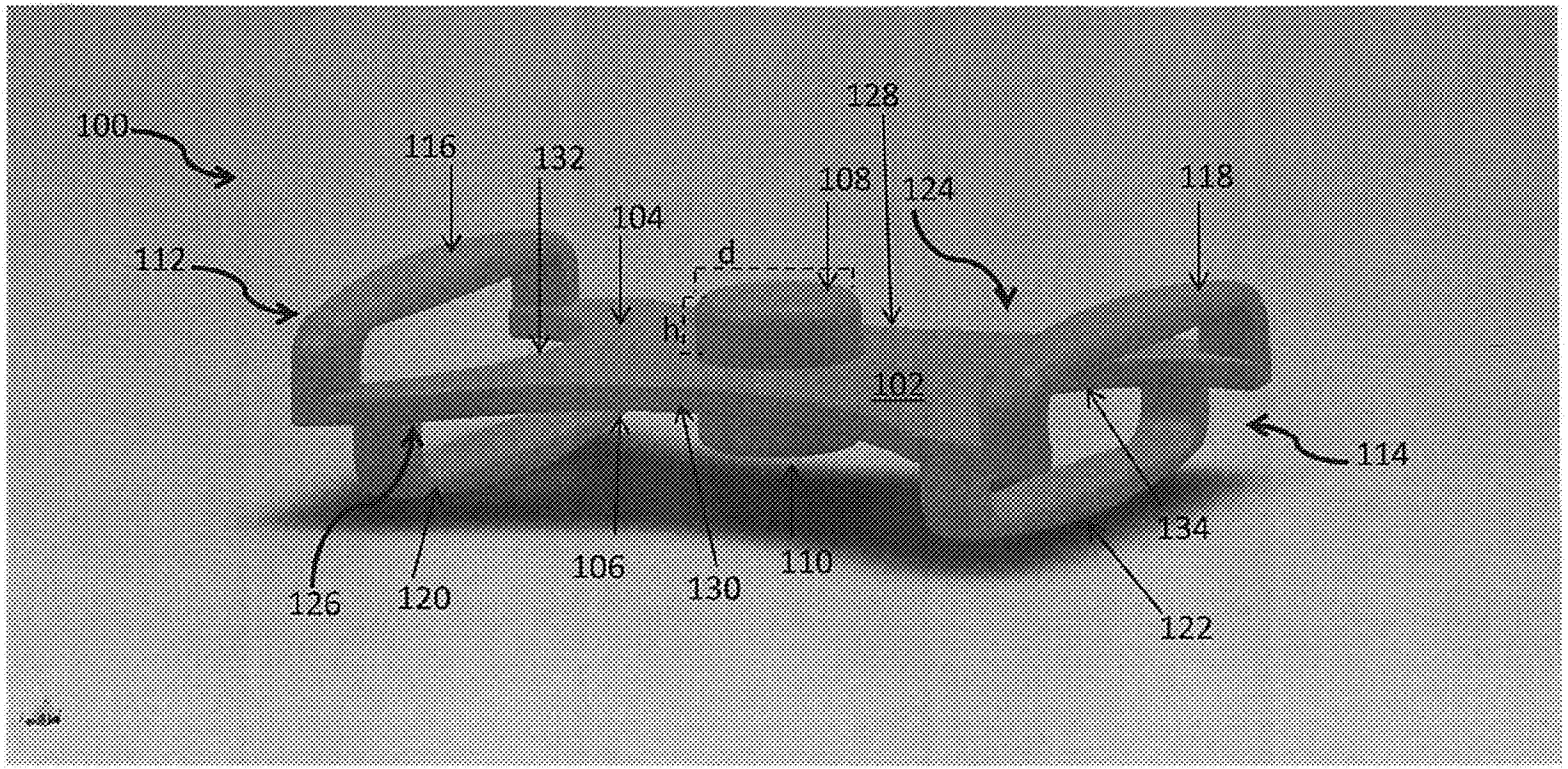
FIG. 1 is a top perspective view of a fastening device according to one embodiment.
Figure 2:
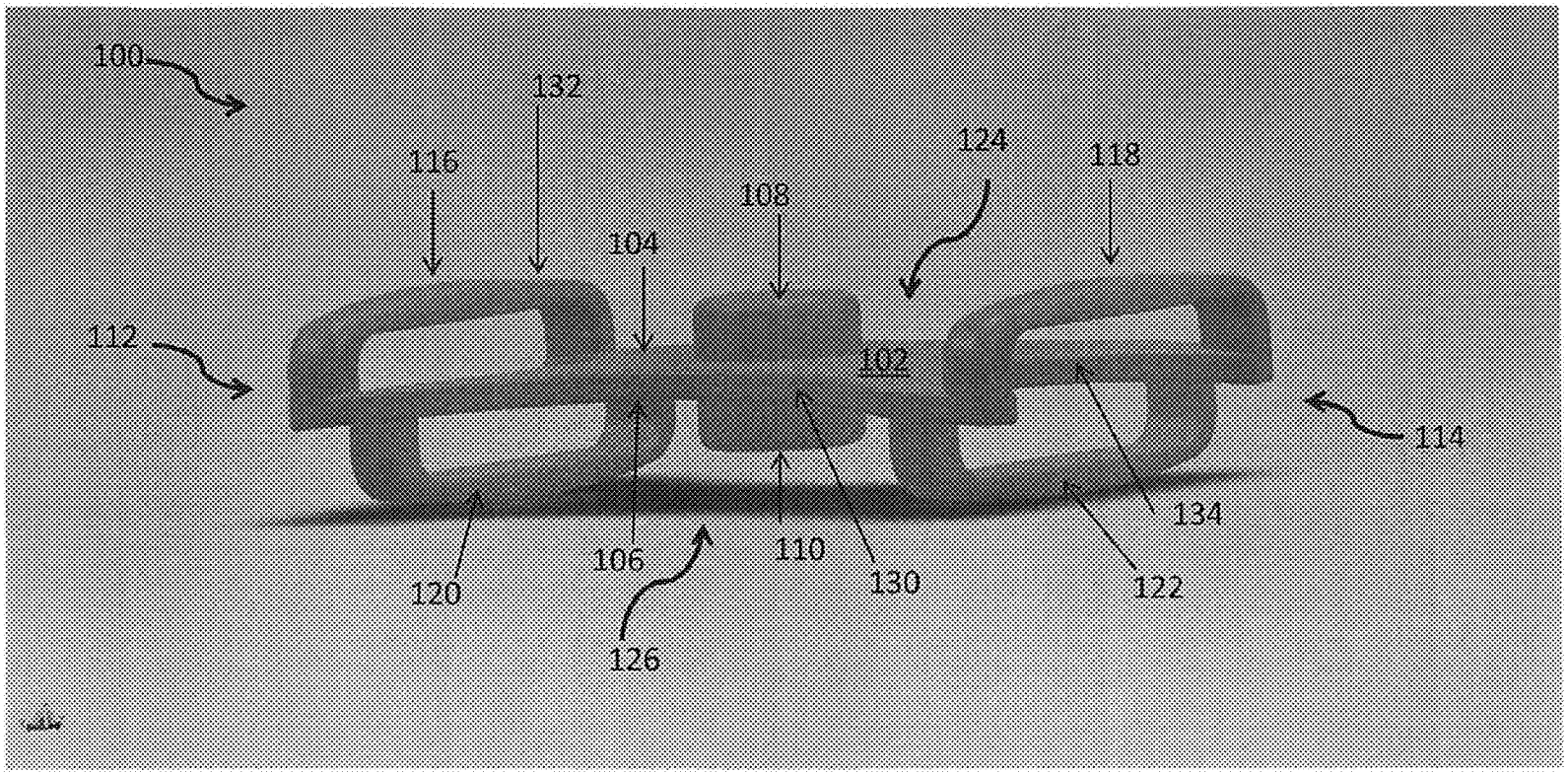
FIG. 2 is a side perspective view of a fastening device.
Figure 5:
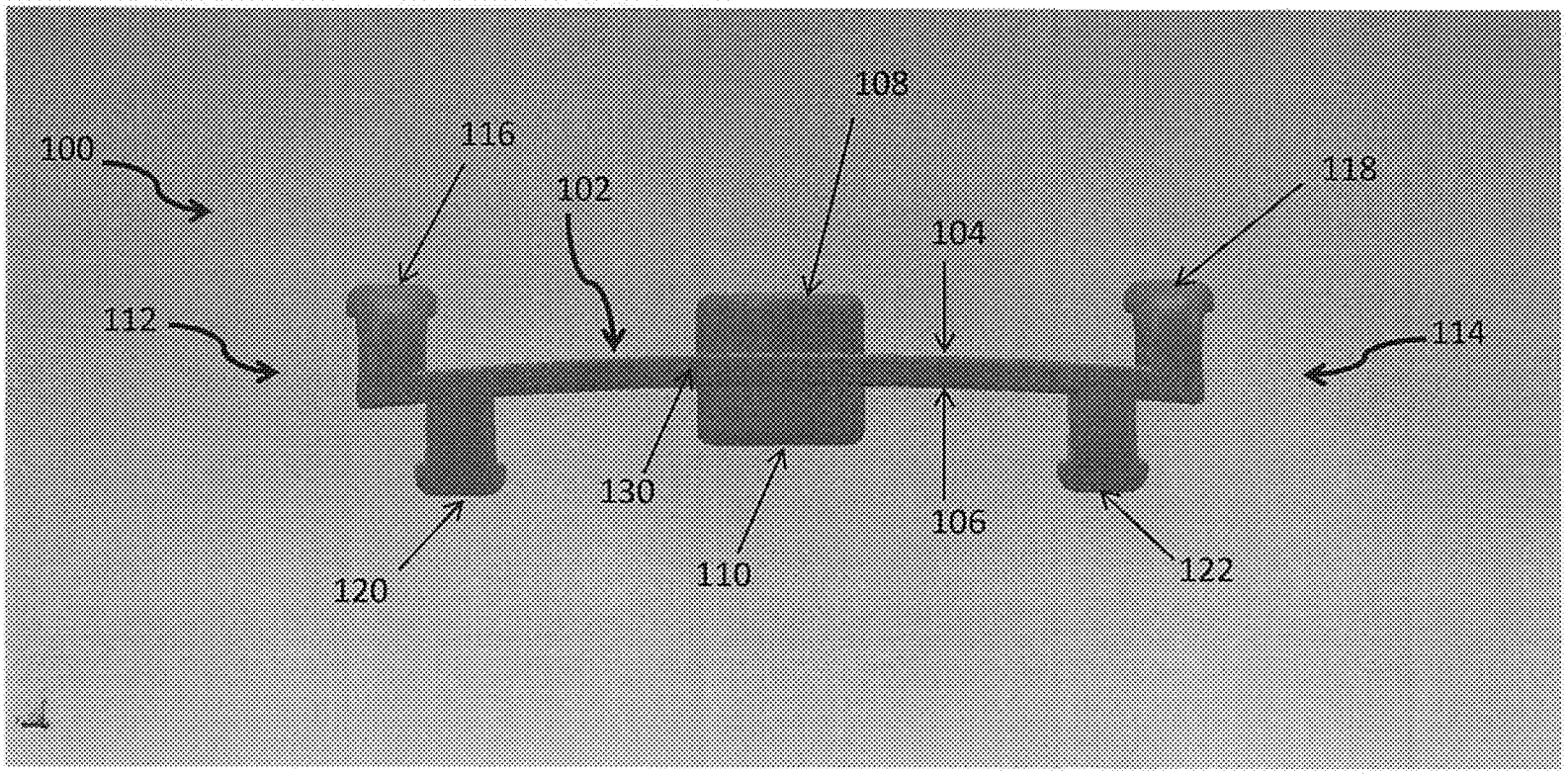
FIG. 5 is a side elevation view of a fastening device.

A fastening member 100 according to one embodiment is illustrated in the various views of FIGS. 1-5. With reference to FIGS. 1-5, the fastening member 100 may include a plate member 102 having a front surface 104 and a rear surface 106. The plate member 102 may be a flat plate member, and in embodiments may be slightly angled or curved, such as shown in the side elevation view of FIG. 5. At least one first protrusion 108 extends from front surface of the plate member 102. At least one second protrusion 110 extends from rear surface 106 of the plate member 102. Each of the protrusions 108, 110 may be substantially centrally located on the plate member 102. As shown in FIGS. 1, 2 and 5, for example, the protrusions 108, 110 may be aligned with one another on opposite sides of the plate member 102. In some embodiments, the protrusions 108, 110 may not be aligned with one another.

In operation, the front surface 104 of the plate member 102 is configured to receive a first strap portion (not shown) such that the first strap portion may extend over and adjacent to the front surface 104. The rear surface 106 is configured to receive a second strap portion (not shown) such that the second strap portion may extend over and adjacent to the rear surface 106. The first protrusion 108 is configured to extend through an opening in a first strap portion so as to enable the first strap portion to lie flat along the first surface 104 with the first protrusion 108 extending through the opening. The second protrusion 110 is configured to extend through an opening in the second strap portion so as to enable the second strap portion to lie flat along the second surface 106 with the second protrusion 110 extending through the opening. The first and second protrusions 108, 110 are configured to prevent the respective strap portions from sliding laterally relative to each other or relative to the respective surfaces 104, 106 of the plate member 102 to which the strap portions are engaged.

The protrusions 108, 110 may have any suitable shape, such as a generally cylindrical shape as shown in FIGS. 1-5. In various embodiments, the protrusions 108, 110 may be ovoid, triangular, quadrilateral, polygonal, irregularly shaped, etc.

As shown in FIG. 1, the protrusions 108, 110 may have a height dimension ("h") and a cross-sectional diameter dimension ("d"). In various embodiments, the cross-section diameter dimension, d, of at least one protrusion 108, 110 may be larger than the height dimension, h, of the at least one protrusion 108, 110. In embodiments, a ratio of the cross-sectional diameter dimension to the height dimension (i.e., d:h) may be between about 1:5 and about 5:1 (e.g., between 1:3 and 3:1).

More than one protrusion may be provided on either or both of the first surface 104 and the second surface 106. The openings on the straps are formed to correspond to the shape of the protrusions with which they engage.

The protrusion may have a uniform shape and diameter along its height dimension, h, or in some embodiments, the shape and/or diameter of the protrusion may vary along the height dimension. For example, the protrusion may include a diameter that narrows proximate a tip portion to facilitate the insertion of the protrusion through a corresponding opening in the strap. The protrusion may also have a groove or re-entrant portion along its height dimension, for example, to help prevent the strap from slipping off of the protrusion.

The protrusion 108 extending from the front surface 104 may be substantially identical to the protrusion 110 extending from the rear surface 106, as is shown in FIGS. 1-5. In other embodiments, the protrusion 108 extending from the front surface 104 may have a different size and/or shape than the protrusion 110 extending from the rear surface 106. In these embodiments, a first strap portion having openings corresponding to the size and shape of the first protrusion 108 may be fastened to the front surface 104 and a second strap portion having openings corresponding to the size and shape of the second protrusion 110 may be fastened to the rear surface 106. In certain embodiments, it may be desirable to provide substantially identical protrusions 108, 110 on the front and rear surfaces of the plate member 102. This may be beneficial, for example, where the strap is a belt and the fastening device 100 is utilized as a buckle for the belt. In embodiments, the belt may be a reversible belt, meaning the belt may be worn with either of its two major surfaces facing out. As belts tend to stretch over time and take the curve of the wearer's hips, to reverse a belt that has taken this curve generally requires both ends to fasten to the buckle in identical ways.

The fastening device 100 may include at least one retaining member attached to the plate member 102 and extending at least partially above a surface 104, 106 of the plate member 102. As shown in FIGS. 1-5, the fastening device 100 according to one embodiment includes a first pair of retaining members 116, 118 extending above the front surface 104, and a second pair of retaining members 120, 122 extending above the rear surface 106. In this embodiment, the retaining members 116, 118, 120, 122 comprise raised arms that extend between a first end 124 and a second end 126 of the plate member 102. The retaining members 116, 118 extending above the first surface 104 are located proximate to a third end 112 and a fourth end 114 of the plate member 102, respectively. Similarly, the retaining members 120, 122 extending above the second surface 106 are located proximate to the third end 112 and the fourth end 114 of the plate member 102, respectively.

The first pair of retaining members 116, 118 is configured such that a first strap portion (not shown) may fit between the retaining members 116, 118 and the front surface 104 of the plate member 102. The retaining members 116, 118 may thus assist in securing the first strap portion adjacent to the front surface 104 of the plate member 102, and may inhibit the strap portion from being pulled away from the plate member 102 (i.e., in a direction that is substantially normal to the front surface 104 of the plate member). Likewise, the second pair of retaining members 120, 122 may be configured such that a second strap portion (not shown) may fit between the retaining members 120, 122 and the rear surface 106 of the plate member 102, and may thus assist in securing the second strap member adjacent to the rear surface 106 of the plate member 102 and inhibit the second strap member from being pulled away from the rear surface 106.

As is shown most clearly in the perspective views of FIGS. 1 and 2 and in the side elevation view of FIG. 5, in some embodiments the first pair of retaining members 116, 118 disposed over the front surface 104 of the plate member 102 may be offset from the second pair of retaining members 120, 122 disposed over the rear surface 106 of the plate member 102. In other embodiments, the respective sets of retaining members may not be offset, and the first pair of retaining members may be aligned with the second pair of retaining members on the opposite side of the plate member 102.

The retaining members may be offset as shown in FIGS. 1-5 so that the strap portion disposed on one side (e.g., the rear side) of the fastening device 100 may be more securely fastened to the fastening device 100 while the strap portion disposed on the opposite side (e.g., the front side) may be easier to fasten and unfasten. Where a pair of retaining members are positioned relatively close together (such as retaining members 120 and 122) they may provide for more secure fastening of the strap portion to the adjacent surface of the plate member. However, placing the retaining members close together may also make it more difficult to fasten, unfasten and/or adjust the strap portion, due to the relatively close geometry of the pair of retaining members and the protrusion with which the strap opening is engaged. Conversely, where the pair of retaining members are positioned relatively further apart (such as retaining members 116 and 118) they may provide slightly less secure fastening but also may make it easier to fasten, unfasten and/or adjust the strap portion. The optimal position of the retaining members may also be a function of the strap(s) intended to be used in conjunction with the fastening device 100. For example, where the straps are made of a relatively flexible material, it may be preferable to position the retaining members closer together, since this may provide more secure fastening, and flexible straps are relatively easier to fasten, unfasten and/or adjust, even when the retaining members are closely spaced. With a more rigid strap, it may be preferable to locate the retaining members further apart.

The offset configuration of the retaining members as shown in FIGS. 1-5 may be advantageous in embodiments in which the strap portions being fastened comprise the respective ends of a belt, and the fastening device 100 is a buckle. The retaining members 120, 122 over the rear (i.e., inward facing) surface 106 may be more closely spaced than the retaining members 116, 118 over the front (i.e., outward facing) surface 104. This may provide secure fastening of the belt to the fasting device (i.e., buckle), particularly with respect to the end of the belt secured to the rear or inner surface 106 of the buckle. The other end of the belt, which is fastened to the front or outer surface 104 of the buckle, may be slightly less securely fastened due to the greater spacing of the retaining members 116, 118, but may be easier for the user to fasten, unfasten and/or adjust.

Figure 3:
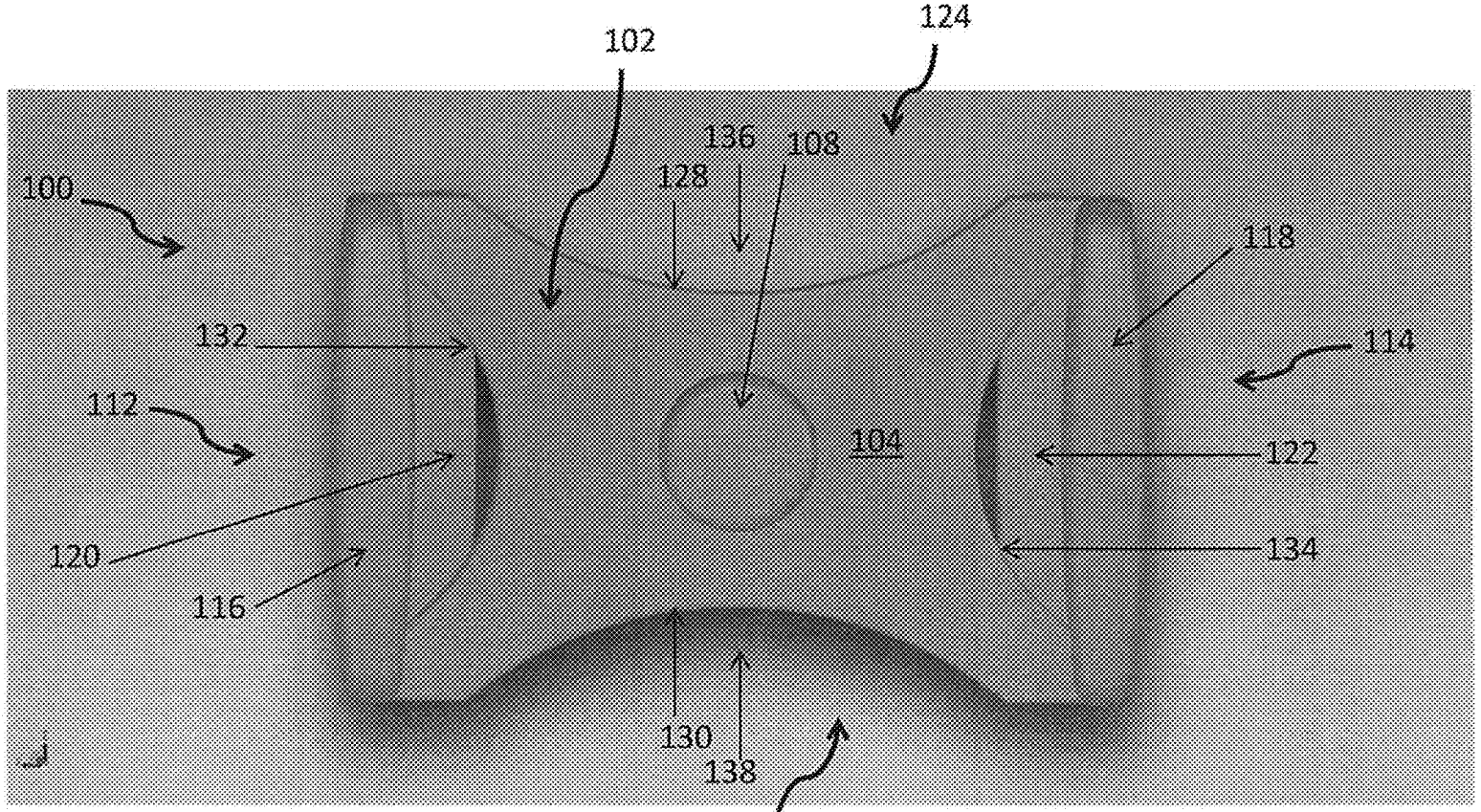
FIG. 3 is a front plan view of a fastening device.
Figure 4:
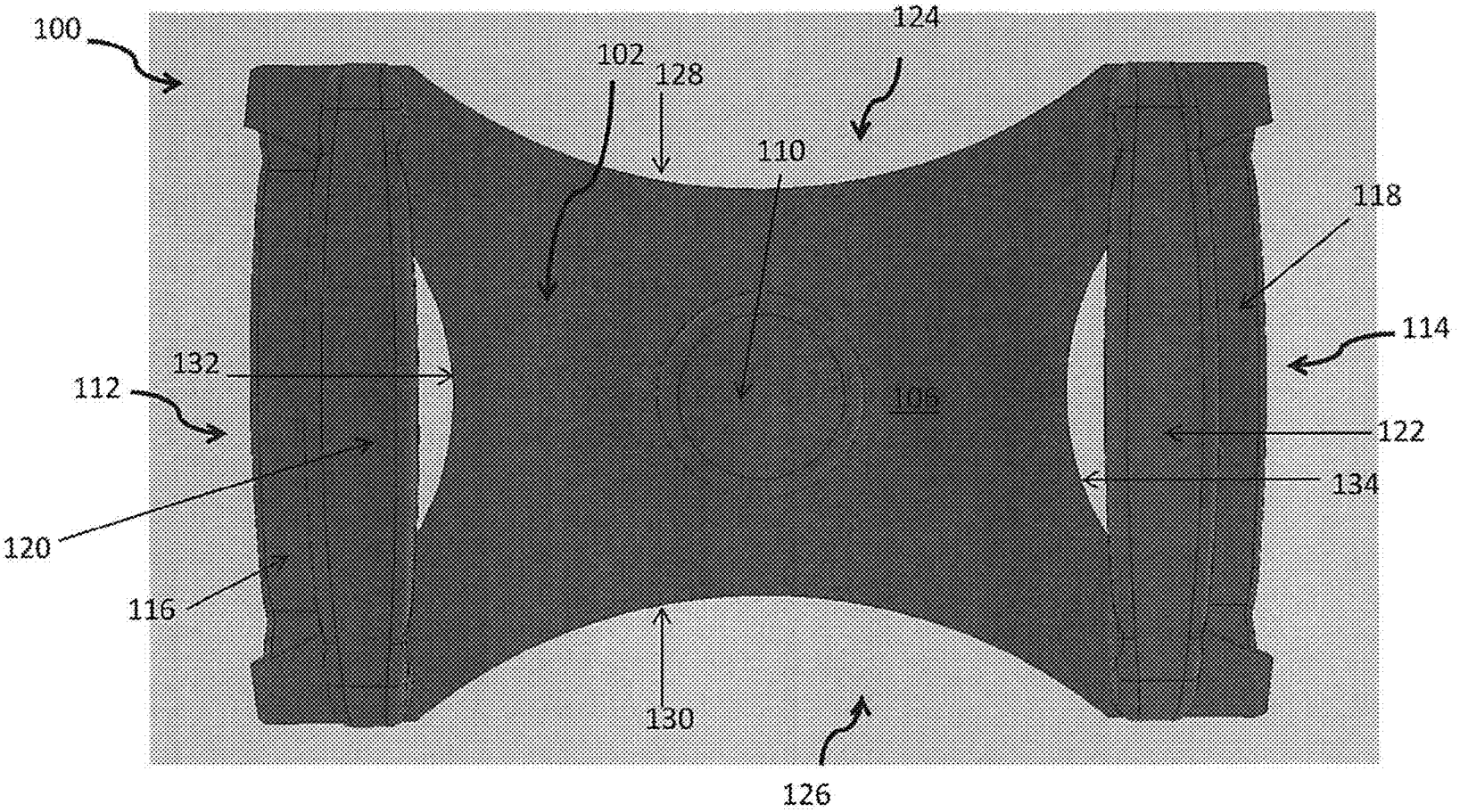
FIG. 4 is a rear plan view of a fastening device.

Referring again to FIGS. 1-5, and in particular the front view of FIG. 3, embodiments of the fastening device 100 may include a concavely shaped edge 132 on the third end 112 of the plate member 102 and/or a concavely shaped edge 134 on the fourth end 114 of the plate member. The concavely shaped edges 132, 134 may be inwardly curved edges, as shown in FIG. 3. In other embodiments, the concavely shaped edges 132, 134 may be inwardly angled edges. The concavely shaped edges 132 may aid the user in inserting the respective strap portions between the retaining members 114, 116, 118, 120 and the plate member 102, as well as in removing or adjusting the strap portions after they have been fastened to the device 100. Other embodiments may not include concavely shaped edges 132, 134, and the edges on the third end 112 and the fourth end 114 of the plate member 102 may be straight or convexly shaped, for example.

Embodiments of the fastening device 100 may also include a concavely shaped edge 128 on the first end 124 of the plate member 102 and/or a concavely shaped edge 130 on the second end 126 of the plate member. The concavely shaped edges 128, 130 may be inwardly curved edges, as shown in FIG. 3. In other embodiments, the concavely shaped edges 128, 130 may be inwardly angled edges. The concavely shaped edges 128, 130 may be configured to define gap regions 136, 138 in the plate member 102. When the respective strap portions are fastened to the device, the strap portions may extend at least partially over the gap regions 136, 138 in the plate member 102, such that the areas of the strap over the gap regions 136, 138 do not contact against the respective surfaces 104, 106 of the plate member 102. This may facilitate the user's unfastening of the strap portions from the fastening device 100, since the user may easily take hold of the strap portion in the gap regions 136, 138 and pull the strap portion away from plate member 102 to bring the opening of the strap portion out of engagement with the respective protrusion 108, 110. Once the opening of the strap portion is removed from the protrusion 108, 110, the strap portion may be moved laterally with respect to the plate member 102, and may be either adjusted or removed completely from the fastening device 100. Other embodiments may not include concavely shaped edges 128, 130, and the edges on the first end 124 and the second end 126 of the plate member 102 may be straight or convexly shaped, for example.

In various embodiments, the fastening device 100 may be an integral one-piece device. The fastening device 100 may be manufactured of metal, wood, composite, resin or any other suitable hard, sturdy material or combinations of materials. The device 100 may be manufactured as a one-piece component using any suitable technique, such as molding, casting, machining, etc. The device 100 may further be manufactured as multiple components that may be assembled and joined using any suitable method, such as via welding, soldering, brazing, adhesives, mechanical fasteners, etc.

Various embodiments may include a fastening device 100 for fastening at least two strap portions that includes no moving parts. This is in contrast to many fastening devices, such as conventional belt buckles, that fasten using an articulating prong. The lack of moving parts in embodiments of the present device may improve durability of the device and help to ensure a reliable fastening connection.

Figure 6A:
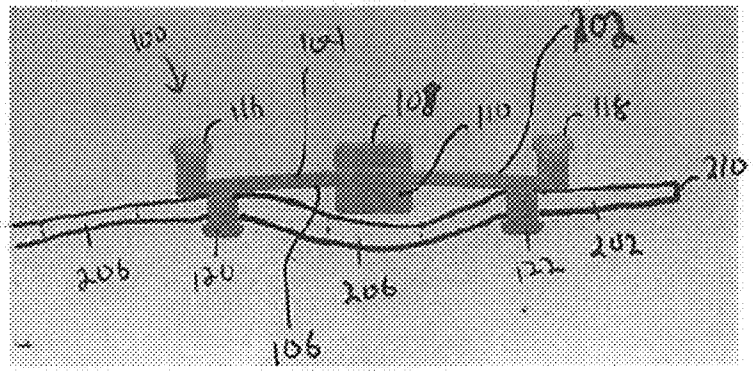
FIGS. 6A-6D schematically illustrate a method of fastening two strap portions using a fastening device according to one embodiment.
Figure 6B:
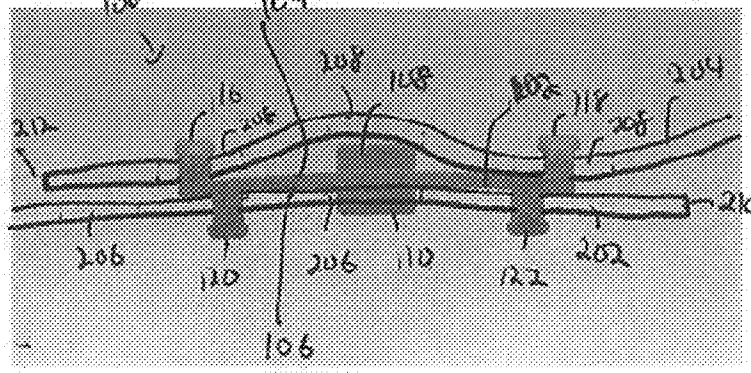
Figure 6C:
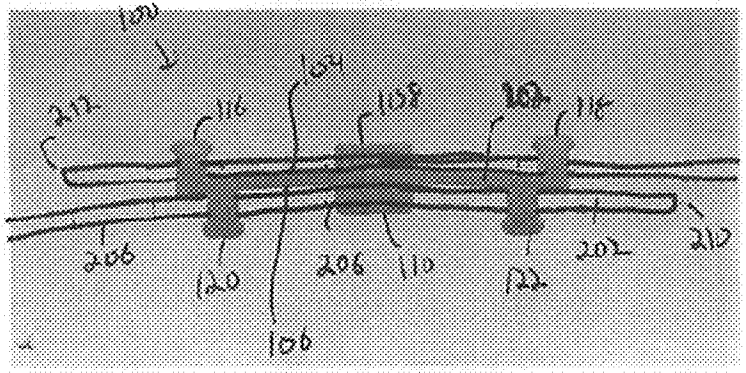
Figure 7A:
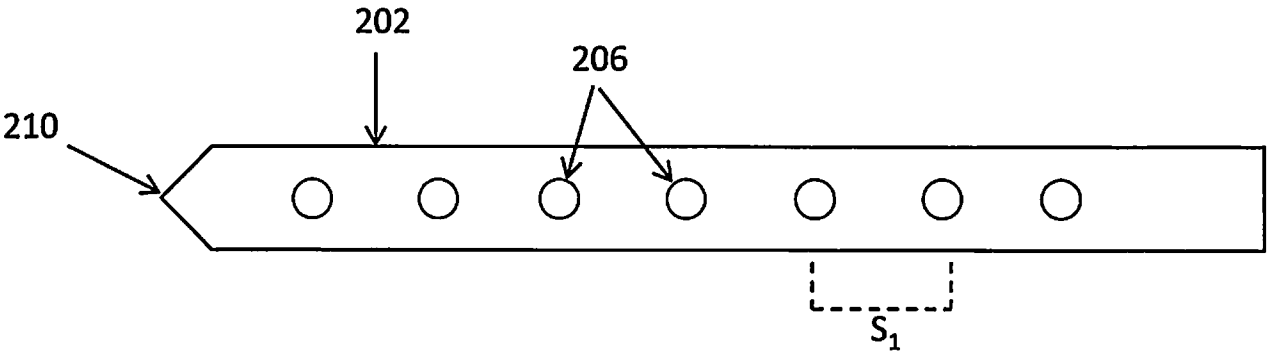
FIGS. 7A and 7B schematically illustrate two strap portions.
Figure 7B:
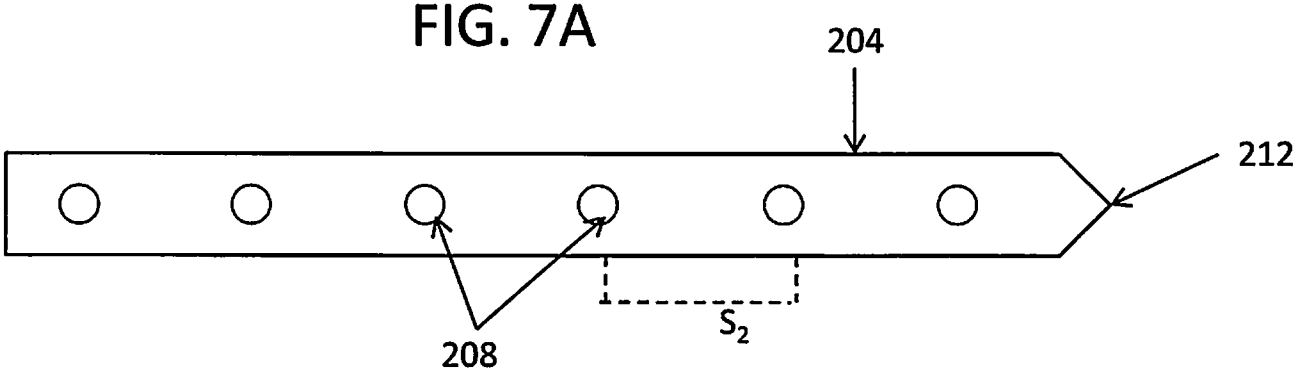

FIGS. 6A-6C illustrate a method of fastening two strap portions 202, 204. The strap portions may be made of any suitable flexible or non-rigid material, such as leather, fabric, woven or non-woven fibers, metal strips, plastic or polymeric material, mesh material, etc. Strap portions 202, 204 are schematically illustrated in FIGS. 7A and 7B. As shown in FIG. 7A, the first strap portion 202 may include at least one opening 206, and preferably includes a set of openings 206 extending along the length of the strap portion. The openings 206 may be equally spaced along the length of the strap at a spacing $S_1$. In embodiments, the first strap portion 202 including the opening(s) 206 may be proximate to an end 210 of a strap. FIG. 7B illustrates the second strap portion 204. The second strap portion 204 includes at least one opening 208, and preferably includes a set of openings 208 extending along the length of the strap portion. The openings 208 may be equally spaced along the length of the strap at a spacing $S_2$. In embodiments, the second strap portion 204 including the opening(s) may be proximate to an end 212 of a strap.

Spacing $S_2$ may be the same or different than spacing $S_1$. In the embodiment of FIGS. 7A and 7B, spacing $S_2$ is different than spacing $S_1$. The openings 206, 208 may be sized and shaped to correspond with protrusions on a fastening device, as discussed above. In embodiments, the openings 206, 208 may be reinforced with a grommet (not shown) disposed around the circumference of the opening that may be formed of metal, plastic or other reinforcing material.

Figure 6D:
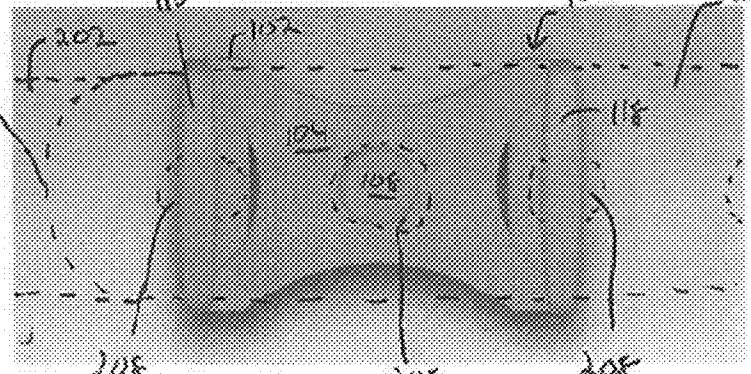

FIG. 6A illustrates the end 210 of first strap portion 202 inserted between retaining members 120 and 122 and the rear surface 106 of the plate member 102. The first strap portion 202 may be advanced until a desired opening 206 of the strap portion 202 is positioned above protrusion 110. The first strap portion 202 may then be pushed against the rear surface 106 of the plate member 102, such that the protrusion 110 extends through the opening 206, as shown in FIG. 6B. As also shown in FIG. 6B, the end 212 of second strap portion 204 is inserted between retaining members 118 and 116 and the front surface 104 of the plate member 102. The second strap portion 204 may be advanced until a desired opening 208 of the strap portion 202 is positioned above protrusion 108. The second strap portion 202 may then be pushed against the front surface 104 of the plate member 102, such that the protrusion 108 extends through the opening 208. The first strap portion 202 and the second strap portion 204 are thereby fastened by the fastening device, as illustrated in the side elevation view of FIG. 6C and the front elevation view of FIG. 6D (which illustrates the strap portions 202, 204 in phantom). The process may be reversed to unfasten one or both of the strap portions. Either or both of strap portion(s) 202, 204 may be adjusted by removing the strap portion from its mating protrusion 108, 110 and advancing the strap portion laterally until a desired opening 206, 208 is aligned over the corresponding protrusion 108, 110. The strap portion may then be refastened at the new position.

In embodiments, the first strap portion 202 and the second strap portion 204 may be portions of the same strap. The strap may be a belt, for example, and the first strap portion 202 may be proximate a first end 210 of the belt and the second strap portion 204 may be proximate a second end 212 of the belt.

In various embodiments of a fastening device 100, either one of strap portions 202, 204 may be removed and/or adjusted on the fastening device 100 without removing or unfastening the other strap portion. In some embodiments, such as shown in FIGS. 7A and 7B, the spacing of the openings 206 in the first strap portion 202 (i.e., $S_1$) is different than the spacing of the openings 208 in the second strap portion 204 (i.e., $S_2$). Where the strap portions are part of the same strap, such as a belt, for example, this may enable finer adjustments to the length of the strap than in a conventional belt or strap in which all the openings are equally spaced. The finer adjustments may be achievable without requiring additional openings being provided in the strap.

In embodiments, a strap or strap portions may be easily removed from fastening device 100. The fastening device 100 may be used with multiple different straps. For example, the fastening device 100 may be a belt buckle that may be used with a plurality of different belts. The fastening device 100 may be useable with a reversible belt. In embodiments, the fastening device 100 may be used to fasten straps for an article of clothing or an accessory (e.g., a handbag). Various embodiments of the fastening device 100 may be applicable for industrial use, sporting equipment, horse tack, etc.

The foregoing method descriptions are provided merely as illustrative examples and are not intended to require or imply that the steps of the various embodiments must be performed in the order presented. As will be appreciated by one of skill in the art the order of steps in the foregoing embodiments may be performed in any order. Words such as "thereafter," "then," "next," etc. are not necessarily intended to limit the order of the steps; these words may be used to guide the reader through the description of the methods. Further, any reference to claim elements in the singular, for example, using the articles "a," "an" or "the" is not to be construed as limiting the element to the singular.

The preceding description of the disclosed aspects is provided to enable any person skilled in the art to make or use the present invention. Various modifications to these aspects will be readily apparent to those skilled in the art, and the generic principles defined herein may be applied to other aspects without departing from the scope of the invention. Thus, the present invention is not intended to be limited to the aspects shown herein but is to be accorded the widest scope consistent with the principles and novel features disclosed herein.

What is claimed is:

1. A fastening device, comprising:

a plate member having a front surface and a rear surface opposite the front surface, the front surface being configured to receive a first strap portion such that the first strap portion extends over and adjacent to the front surface and the rear surface being configured to receive a second strap portion such that the second strap portion extends over and adjacent to the rear surface;

a first protrusion extending from the front surface such that when the front surface receives the first strap portion, the first protrusion is configured to extend into an opening in the first strap portion to inhibit lateral movement of the first strap portion relative to the plate member;

a second protrusion extending from the rear surface such that when the rear surface receives the second strap portion, the second protrusion is configured to extend into an opening in the second strap portion to inhibit lateral movement of the second strap portion relative to the plate member;

a pair of first retaining members attached to the plate member and extending at least partially above the front surface and configured such that the first strap portion may be positioned between each of the first retaining members and the front surface of the plate member, each of the first retaining members comprising a raised arm that extends between a first end and a second end of the plate member, and each of the first retaining members being located proximate to a third end and a fourth end of the plate member, respectively; and a pair of second retaining members attached to the plate member and extending at least partially above the rear surface and configured such that the second strap portion may be positioned between each of the second retaining members and the rear surface of the plate member, each of the second retaining members comprising a raised arm that extends between the first end and the second end of the plate member, and each of the second retaining members being located proximate to the third end and the fourth end of the plate member, respectively, and the pair of first retaining members are offset relative to the pair of second retaining members such that one pair of retaining members are more closely spaced than the other pair of retaining members.

2. The fastening device of claim 1, wherein the fastening device comprises no moving parts.

3. The fastening device of claim 1, wherein the fastening device comprises a one-piece structure.

4. The fastening device of claim 1, wherein the fastening device is configured to enable either of the first strap portion or the second strap portion to be removed from the fastening device without requiring the other strap portion to be removed from the fastening device.

5. The fastening device of claim 1, wherein the pair of first retaining members are offset relative to the pair of second retaining members such that the second pair of retaining members are more closely spaced than the first pair of retaining members.

6. The fastening device of claim 1, wherein the first protrusion and the second protrusion have identical sizes and shapes.

7. The fastening device of claim 1, wherein the first protrusion and the second protrusion have different sizes and/or shapes.

8. The fastening device of claim 1, wherein at least one of the first protrusion and the second protrusion has a generally cylindrical shape.

9. The fastening device of claim 1, wherein at least one of the first protrusion and the second protrusion has a shape that is ovoid, triangular, quadrilateral, polygonal or irregularly shaped.

10. The fastening device of claim 1, wherein at least one of the first protrusion and the second protrusion has a height dimension and a cross-sectional diameter dimension, and the cross sectional diameter dimension is greater than the height dimension.

11. The fastening device of claim 1, wherein at least one of the first protrusion and the second protrusion has a height dimension and a cross-sectional diameter dimension, and the ratio of the cross sectional diameter dimension to the height dimension is between about 1:5 and about 5:1.

12. The fastening device of claim 1, wherein the plate member comprises at least one concavely shaped edge on an end of the plate member.

13. The fastening device of claim 12, wherein the plate member comprises concavely shaped edges on a first end, a second end, a third end and a fourth end of the plate member.

14. The fastening device of claim 1, further comprising:

a first strap portion positioned over and adjacent to the front surface of the plate member and including at least one opening having a size and shape that corresponds with a size and shape of the first protrusion, the first protrusion extending through the opening; and a second strap portion positioned over and adjacent to the rear surface of the plate member and including at least one opening having a size and shape that corresponds with a size and shape of the second protrusion, the second protrusion extending through the opening.

15. The fastening device of claim 14, wherein the first strap portion and the second strap portion are portions of different straps.

16. The fastening device of claim 14, wherein the first strap portion and the second strap portion are portions of the same strap.

17. The fastening device of claim 16, wherein the first strap portion is proximate a first end of the strap, and the second strap portion is proximate a second end of the strap.

18. The fastening device of claim 17, wherein the first strap portion comprises a first plurality of openings having a first spacing and the second strap portion comprises a second plurality of openings having a second spacing.

19. The fastening device of claim 18, wherein the first spacing is the same as the second spacing.

20. The fastening device of claim 16, wherein the strap is a belt.

21. A method of fastening at least two strap portions using a fastening device, comprising:

positioning a first strap portion over a rear surface of a plate member by inserting the first strap portion between the rear surface of the plate member and a pair of first retaining members attached to the plate member and extending at least partially above the rear surface and configured such that the first strap portion is positioned between each of the first retaining members and the rear surface of the plate member, each of the first retaining members comprising a raised arm that extends between a first end and a second end of the plate member, and each of the first retaining members being located proximate to a third end and a fourth end of the plate member, respectively;

aligning an opening in the first strap portion with a first protrusion extending from the rear surface of the plate member;

inserting the first protrusion into the opening in the first strap portion;

positioning a second strap portion over a front surface of a plate member, the front surface being opposite the rear surface of the plate member, by inserting the second strap portion between the front surface of the plate member and a pair of second retaining members attached to the plate member and extending at least partially above the front surface and configured such that the second strap portion is positioned between each of the second retaining members and the front surface of the plate member, each of the second retaining members comprising a raised arm that extends between the first end and the second end of the plate member, and each of the second retaining members being located proximate to the third end and the fourth end of the plate member, respectively, and the pair of second retaining members is offset relative to the pair of first retaining members such that one pair of retaining members are more closely spaced than the other pair of retaining members;

aligning an opening in the second strap portion with a second protrusion extending from the front surface of the plate member; and inserting the second protrusion into the opening in the second strap portion.

22. The method of claim 21, wherein the first strap portion and the second strap portion comprise opposite ends of a strap.

23. A fastening device, comprising:

a plate member having a front surface and a rear surface opposite the front surface, the front surface being configured to receive a first strap portion such that the first strap portion extends over and adjacent to the front surface and the rear surface being configured to receive a second strap portion such that the second strap portion extends over and adjacent to the rear surface;

a first protrusion extending from the front surface such that when the front surface receives the first strap portion, the first protrusion is configured to extend into an opening in the first strap portion to inhibit lateral movement of the first strap portion relative to the plate member;

a second protrusion extending from the rear surface such that when the rear surface receives the second strap portion, the second protrusion is configured to extend into an opening in the second strap portion to inhibit lateral movement of the second strap portion relative to the plate member;

a first strap portion positioned over and adjacent to the front surface of the plate member and including at least one opening having a size and shape that corresponds with a size and shape of the first protrusion, the first protrusion extending through the opening; and a second strap portion positioned over and adjacent to the rear surface of the plate member and including at least one opening having a size and shape that corresponds with a size and shape of the second protrusion, the second protrusion extending through the opening, wherein the first strap portion and the second strap portion are portions of the same strap, the first strap portion is proximate a first end of the strap, and the second strap portion is proximate a second end of the strap, the first strap portion comprises a first plurality of openings having a first spacing and the second strap portion comprises a second plurality of openings having a second spacing and the first spacing is different than the second spacing.

24. The method of claim 21, wherein the pair of first retaining members are more closely spaced than the pair of second retaining members.

* * * * *